US005520512A

United States Patent [19]

Walker et al.

[11] Patent Number: 5,520,512

[45] Date of Patent: May 28, 1996

[54] GAS TURBINES HAVING DIFFERENT FREQUENCY APPLICATIONS WITH HARDWARE COMMONALITY

[75] Inventors: Alan Walker, Niskayuna; Terrill K. Staley, Albany, both of N.Y.

[73] Assignee: General Electric Co., Schenectady, N.Y.

[21] Appl. No.: 414,701

[22] Filed: Mar. 31, 1995

[51] Int. Cl.[6] ..... F01D 1/04; F01D 9/04

[52] U.S. Cl. ..... 415/199.5; 415/189; 415/193; 415/209.1; 415/211.2; 415/912; 416/198 A; 416/201 R; 29/888.04; 29/884.21; 29/889.22

[58] Field of Search ..... 415/199.4, 199.5, 415/193, 194, 189, 190, 209.1, 211.2, 912; 416/198 A, 201 R; 29/888.021, 889.1, 889.21, 889.22

[56] References Cited

U.S. PATENT DOCUMENTS 5,110,256 5/1992 Groenendaal, Jr. ..... 415/190

FOREIGN PATENT DOCUMENTS 2408641 8/1975 Germany ..... 415/912

*Primary Examiner*—Edward K. Look
*Assistant Examiner*—Christopher Verdier
*Attorney, Agent, or Firm*—Nixon & Vanderhye

[57] ABSTRACT

Power generation turbines having different power outputs for different power grid frequency applications have modular second and third stages, rotors, bucket wheels for all stages and other ancillary parts. The first and second turbines have sizes not geometrically scaled according to speed. Four-stage turbines having different outputs for different power grid frequencies not geometrically scaled have an identical annulus through the first, second and third stages, different geometry in the first and fourth stages, and identical geometry in the second and third stages.

22 Claims, 4 Drawing Sheets

GAS TURBINES HAVING DIFFERENT FREQUENCY APPLICATIONS WITH HARDWARE COMMONALITY

TECHNICAL FIELD

The present invention relates to gas turbines for operation at different frequency applications having a high degree of hardware commonality and particularly relates to gas turbines for land use operation at 50 Hz and 60 Hz power grid frequencies using common modular components.

BACKGROUND

Gas turbines, when used for land use electrical power generation, are typically required for both 50 Hz and 60 Hz applications, depending upon power grid frequency. The costs involved in developing and producing machines for both frequencies are quite significant. For example, components for a turbine designed for each different frequency application are typically unique to that turbine. This results in higher investment costs for tooling and virtually no commonality of hardware as between the two turbines, which would beneficially impact turbine costs.

One approach commonly used for developing gas turbines for 50 Hz and 60 Hz frequency applications is simple geometric scaling of one design to a second frequency. Scaling is based on the principal that one can reduce or increase the physical size of a machine while simultaneously increasing or decreasing rotational speed to produce aerodynamically and mechanically similar compressors and turbines for the different frequency applications. Application of scaling techniques has enabled the development of turbines for both frequency applications which, while reducing development costs, still results in turbine components unique to the turbine for a particular frequency application. For example, components for a turbine designed for a 50 Hz application are scaled geometrically by the frequency ratio 50/60=0.833 to yield similar turbine performance at 60 Hz frequency. With this fixed geometric scaling, power output scales by the inverse square of the frequency, i.e., $(50/60)^2=0.694$. Thus, a turbine sized at 50 Hz to provide a power output of 100 megawatts would, when geometrically scaled by a factor of 0.833, provide a power output of 69.4 megawatts at 60 Hz. More generally, there is a fixed relationship or ratio between output power at one speed and power output at another speed when turbine designs are geometrically scaled. The advantage of this scaling approach is that components sized at one frequency can be readily redesigned at the scaled frequency. However, the output of the turbine is fixed by the scale factor and thus one or the other of the turbines may not be optimum for a particular application. That is, market demands may require turbines for operation at different frequencies and the power output of one turbine at one frequency may not result in the desired output of the other turbine at the other frequency when the first turbine is geometrically scaled to afford the second turbine. Equally important, the components (hardware) for a base turbine for one frequency application have virtually no commonality with the components (hardware) of the scaled turbine for the different frequency application, resulting in increased tooling and component parts costs as well as other disadvantages.

DISCLOSURE OF THE INVENTION

According to the present invention, there are provided gas turbines which can be used for 50 Hz and 60 Hz applications, respectively, with substantial and significant commonality of hardware with minimum or negligible loss in turbine performance for each application whereby substantial reductions in costs are realized by a commonality of design, hardware and tooling. Additional economic benefits are realized in terms of reduced design cycle times and resources necessary to design and manufacture the turbines for use at different power outputs and frequencies. Moreover, the present invention breaks the relationship between geometric scaling and power output whereby the output of the 50 Hz and 60 Hz machines can be set independently of the turbine by setting compressor mass flow and adjusting the turbine accordingly. In short, the design of turbines with different power outputs at different frequencies, according to this invention, is no longer constrained by the geometric scaling factor. The respective power outputs are not necessarily proportional to the square of the inverse of their respective power grid frequencies.

For the design of one or the other of the two turbines for different frequency applications, e.g., 50 Hz or 60 Hz, and considering the desirability of having an identical hot gas flowpath to the extent possible for the two turbines, a turbine exit mach number is initially set such that the pressure loss in the diffuser downstream of the turbine and its mechanical performance are acceptable. For a given firing temperature, the turbine pressure ratio and quantity of cooling air introduced into the turbine airfoils and ancillary parts such as shrouds and into the gas path determine the metal temperature of the last-stage bucket. With the selection of an appropriate alloy for the last-stage bucket, the maximum allowable centrifugal stress can be determined, for example, for the 60 Hz machine. This centrifugal stress is directly proportional to $AN^2$ where A is the annulus area formed by the last-stage buckets and N is the speed of rotation. By limiting the exit mach number, the maximum allowable flow through the turbine can be determined and hence its power output.

For a given initial design, e.g., either 50 or 60 Hz, and using as an example, 60 Hz, the hub (inner) radii of the flowpath can be set considering turbine performance, rotor length and weight, leakages and the like. With the hub radii and last-stage annulus area set, bucket tip radii can be set. Because of the $N^2$ term in the centrifugal stress calculation, the bucket lengths are limited by the higher speed 60 Hz turbine. To provide the additional turbine power output necessary for a 50 Hz machine, given the constraints for the design of the 60 Hz machine, and assuming identical firing temperature and the same gas flow properties, as well as substantially similar pressure ratios, the mass flow through the constant area flowpath of the turbine must be increased. To provide for this increased mass flow while maintaining an acceptable exit mach number, the height of the exit annulus is increased to afford increased exit area. This increase in height of the last-stage nozzles and buckets for a 50 Hz turbine is accommodated in the tip area, while maintaining a common hub radius with the 60 Hz turbine. Consequently, the last-stage, e.g., the fourth stage in a four-stage turbine, has increased nozzle and bucket tip radii. To maintain turbine pressure ratio while accommodating increased mass flow, the first-stage nozzles and buckets are changed to increase their throat areas, i.e., the area available for passage of flow. The cross-sectional area of the annulus forming the first-stage flowpath remains the same, although its flow area increases due, e.g., to the change in the orientation of its buckets and partitions.

Importantly, the intermediate stages, e.g., the geometry of the second and third stages in a four-stage turbine, according to the present invention, remain unchanged as between the turbines of different power outputs at different frequencies. While the speed and mass flow change between the 50 Hz and 60 Hz turbines causes the incidence angle of gas flowing onto the airfoils of the second and third stages to change slightly, those changes in incidence angle can be accepted by the airfoil design for those stages. Further, while the gas pressure within the flowpath changes with turbines of different outputs, cooling flow and purge flow source pressures can be selected to ensure adequate backflow margin is maintained in both machines to preclude hot gas in the flowpath from entering the rotor cavities and damaging the rotor structure, or entering coolant passages within the gas path components.

It will be appreciated that bucket airfoils are normally oriented so that centrifugally generated bending loads counteract those generated by gas pressure. In the intermediate stages, e.g., the second and third stage of a four-stage turbine hereof, the airfoils are required to operate at both power outputs and frequencies, resulting in centrifugal bending loads which differ at the two speeds. It has been found, however, that the airfoils can be leaned circumferentially and axially at an intermediate position to reduce net resultant bending stress to acceptable levels at both speeds.

It will be further appreciated from the foregoing that the resulting turbines of different power outputs at different frequencies, for example, 50 and 60 Hz turbines, share a high degree of hardware commonality. Specifically, the rotor, rotor wheels for the buckets for all four stages, the spacers between the stages, the impeller plate, the aft shaft, the forward shaft, seal plates, the buckets for the second and third stages, the second and third-stage nozzles, the diaphragms, the shrouds for the second and third-stage buckets, as well as for the first-stage buckets, the inner shell and the outer shell are common hardware components for both the 50 and 60 Hz turbines. Stated somewhat differently, the items unique to the individual 50 and 60 Hz machines are principally the nozzles and buckets of the first and last stages, the shrouds for the last stage and the diffuser fairing at the exit annulus. The invention can therefore be characterized as having a high degree of modularity among the component turbine parts for use with turbines at different frequency applications, e.g., 50 Hz and 60 Hz applications.

In a preferred embodiment according to the present invention, there are provided respective identical modular components for corresponding turbine stages in first and second turbines having different power outputs for power grids of different respective first and second frequencies wherein the respective power outputs of the turbines are not achievable by geometric scaling, each turbine stage component comprising stationary partitions (nozzles) and rotatable buckets.

In a further preferred embodiment according to the present invention, there is provided a turbine having a first power output and including first, intermediate and final stages, each stage comprising a fixed diaphragm having stationary partitions and a rotatable turbine wheel having buckets, at least one intermediate stage of the turbine having an identical geometry to a corresponding intermediate stage of a second turbine having a second power output different from the first power output where the power outputs are not achievable by geometric scaling of the first and second turbines according to speed.

In a still further preferred embodiment according to the present invention, there is provided power generating apparatus comprising a first turbine having a first power output for connection with a power grid of a first frequency, a second turbine having a second power output different from the first power output for connection with a power grid of a second frequency, each of the first and second turbines having a plurality of stages, with each stage including partitions and buckets, at least one stage in the first turbine and one stage of the second turbine being geometrically identical.

In a still further preferred embodiment according to the present invention, there is provided power generating apparatus comprising a first turbine operable at a first rated speed, a second turbine operable at a second rated speed different from the first speed, each of the first and second turbines having a plurality of stages, with each stage including partitions and buckets, at least one stage in the first turbine and one stage of the second turbine having identically sized and configured partitions and buckets, the first and second turbines having sizes not geometrically scaled according to speed.

In a still further preferred embodiment according to the present invention, there is provided a method of manufacturing turbines for use at different power outputs comprising the steps of selecting a desired power output for a first turbine having first, intermediate and final stages, each stage having partitions and buckets, establishing the geometry for the partitions and buckets of each stage for the first turbine, selecting a desired power output for a second turbine having first, intermediate and final stages, each stage of the second turbine having partitions and buckets and the selected power outputs being unobtainable by geometric scaling of the first and second turbines according to speed, establishing the geometry for the partitions and buckets of each stage for the second turbine including providing an intermediate stage of the second turbine with a geometry identical to the geometry of an intermediate stage of the first turbine.

In a still further preferred embodiment according to the present invention, there is provided a method of manufacturing first and second turbines having substantially identical firing temperatures and pressure ratios for use with gas flows having substantially identical properties wherein each turbine has first, intermediate and final stages with each stage including partitions and buckets, comprising the steps of forming a pair of first stages for installation in the first and second turbines, respectively, wherein the first stages have geometries different from one another, forming a pair of last stages for installation in the first and second turbines, respectively, wherein the last stages have geometries different from one another, forming a pair of intermediate stages having geometric characteristics identical to one another for installation in the first and second turbines, respectively, and installing the stages in the first and second turbines, respectively.

Accordingly, it is a primary object of the present invention to provide turbines and methods of constructing turbines wherein non-geometrically scaled turbines have different power outputs at different frequencies with substantial significant commonality of hardware as between the turbines and negligible impact on turbine performance.

BRIEF DESCRIPTION OF THE DRAWINGS

FIG. 3b is a view similar to FIG. 3a illustrating a second turbine having a different power output and frequency than the turbine illustrated in FIG. 3a.

BEST MODE FOR CARRYING OUT THE INVENTION

Figure 1:
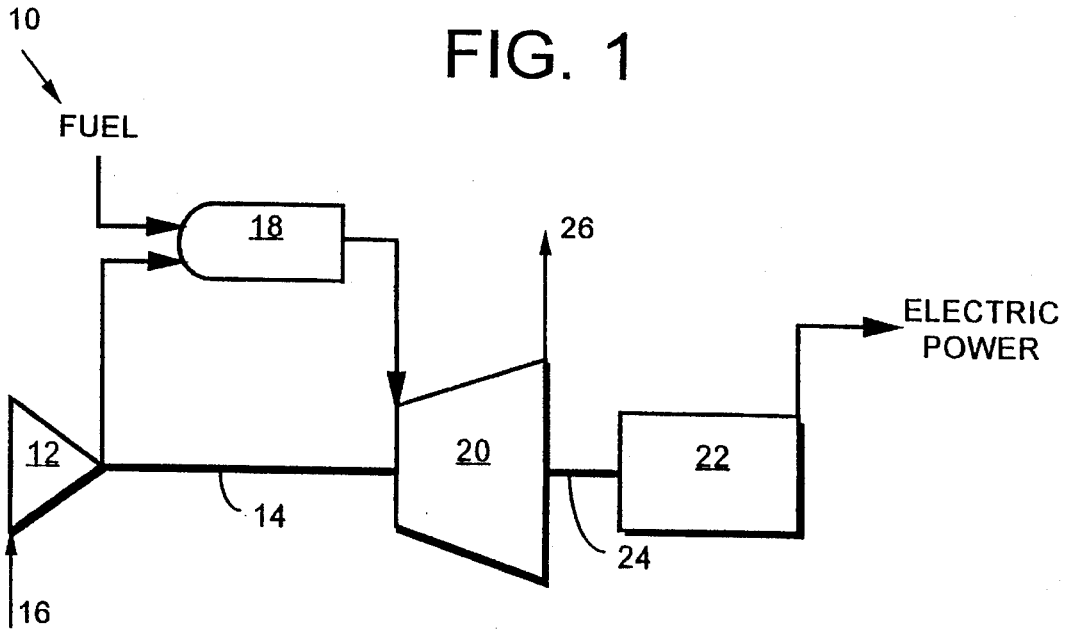
FIG. 1 is a schematic illustration of a gas turbine according to the present invention.

FIG. 1 is a schematic diagram for a simple cycle, single-shaft heavy-duty gas turbine 10 incorporating the present invention. The gas turbine may be considered as comprising a multi-stage axial flow compressor 12 having a rotor shaft 14. Air enters the inlet of the compressor at 16, is compressed by the axial flow compressor 12 and then is discharged to a combustor 18 where fuel such as natural gas is burned to provide high-energy combustion gases which drive the turbine 20. In the turbine 20, the energy of the hot gases is converted into work, some of which is used to drive the compressor 12 through shaft 14, with the remainder being available for useful work to drive a load such as a generator 22 by means of rotor shaft 24 for producing electricity. A typical simple cycle gas turbine will convert 30 to 35% of the fuel input into shaft output. All but 1 to 2% of the remainder is in the form of exhaust heat which exits turbine 20 at 26. Higher efficiencies can be obtained by utilizing the gas turbine 10 in a combined cycle configuration in which the energy in the turbine exhaust stream is converted into additional useful work.

Figure 2:
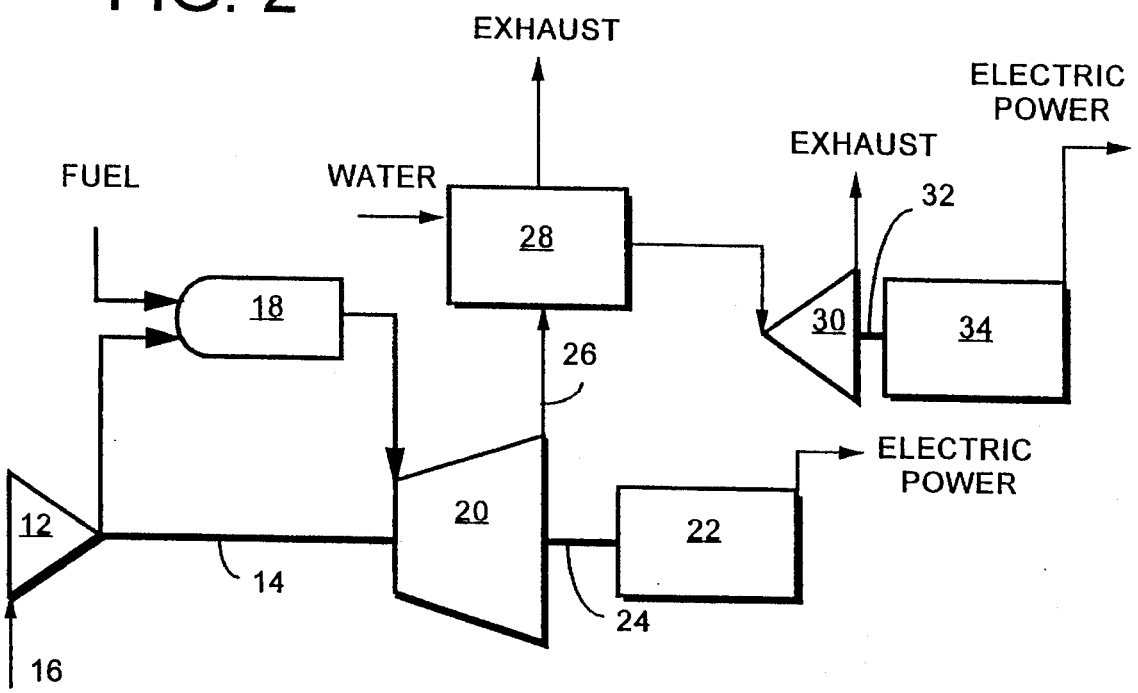
FIG. 2 is a schematic diagram of a combined cycle system employing the gas turbine and heat recovery steam generator for greater efficiency.

FIG. 2 represents a combined cycle in its simplest form, in which the exhaust gases exiting turbine 20 at 26 enter a heat recovery steam generator 28 in which water is converted to steam in the manner of a boiler. Steam thus produced drives a steam turbine 30 in which additional work is extracted to drive through shaft 32 an additional load such as a second generator 34 which, in turn, produces additional electric power. In some configurations, turbines 20 and 30 drive a common generator. Combined cycles producing only electrical power are in the 50 to 60% thermal efficiency range using the more advanced gas turbines.

In both the applications illustrated in FIGS. 1 and 2, the generator is typically supplying power to an electrical power grid. The power grid is conventionally either 50 Hz or 60 Hz, although the scope of the present invention may include turbine power applications at frequencies other than 50 Hz and 60 Hz. As alluded to earlier, conventional practice in supplying turbines for land-based power generation require a unique turbine for each frequency application and rated power output resulting in a lack of commonality of hardware as between the various turbines. While geometric scaling has been applied to design various turbines for use in applications at different frequencies, thus reducing costs, still each turbine is unique. The present invention affords turbines which break the relationship between power output at the different frequencies and the scaling factor, thereby enabling maximization of common turbine hardware for different power and speed or frequency combinations than presently allowed by pure geometric scaling.

Figure 3A:
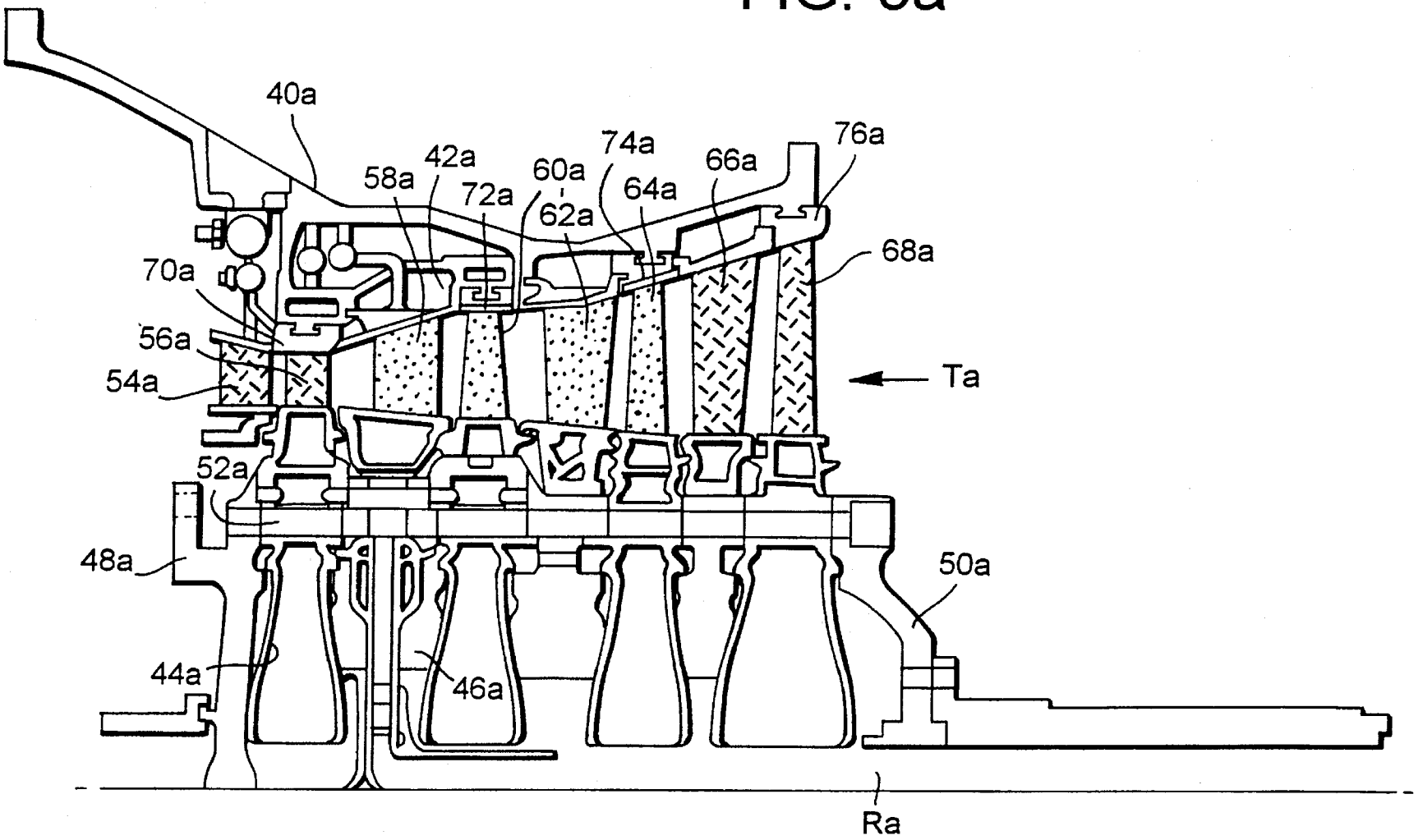
FIG. 3*a* is a schematic cross-sectional view of a four-stage turbine having a predetermined power output and frequency constructed in accordance with the present invention.
Figure 3B:
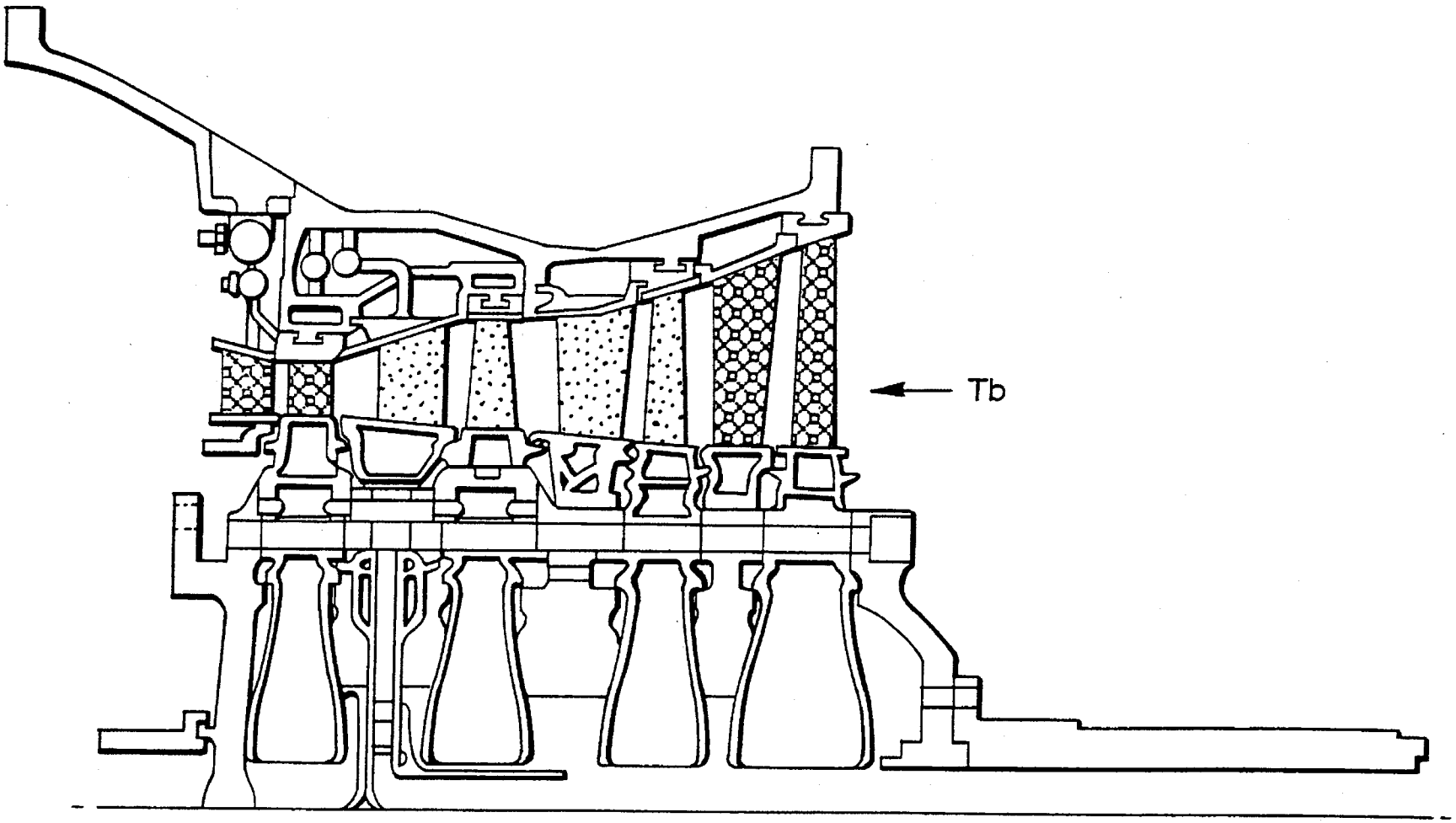

Referring now to FIGS. 3a and 3b, there is illustrated a pair of turbines $T_a$ and $T_b$ for use in the above-identified systems. Turbine $T_a$, for example, illustrated in FIG. 3a, may be for use with 60 Hz applications, whereas turbine $T_b$, illustrated in FIG. 3b, may be for use with 50 Hz applications. Suffice it to say that the two turbines $T_a$ and $T_b$ are designed for different power outputs for the 60 Hz and 50 Hz applications. Referring to FIG. 3a, turbine $T_a$ includes an outer shell 40a forming the structural outer shell or housing of the turbine, an inner shell 42a and a rotor Ra. Rotor Ra mounts a plurality of bucket wheels 44a, as well as spacer wheels 46a between adjoining bucket wheels 44a, all bolted together between forward and aft shafts 48a and 50a, respectively, by a plurality of bolts 52a arranged about the longitudinal axis of the rotor Ra. The turbine $T_a$ includes a first stage, at least one intermediate stage (preferably two) and a last stage, each stage comprising a diaphragm mounting a plurality of circumferentially spaced partitions or nozzle vanes between inner and outer rings and a plurality of buckets mounted on the turbine wheels. In the illustrated form, a four-stage turbine is provided, with first-stage nozzles 54a, buckets 56a; second-stage nozzles 58a and buckets 60a; third-stage nozzles 62a and buckets 64a; and fourth-stage nozzles 66a and buckets 68a. The nozzles 54a, 58a, 62a and 66a form part of diaphragms mounting the partitions extending between the inner and outer diaphragm rings in the usual manner. Additionally, the inner shell 42a carries shrouds 70a and 72a about the outer tips of buckets 56a and 60a of the first and second stages, respectively. Shrouds 74a and 76a are carried directly by the outer shell 40a about the tips of the third and fourth-stage buckets 64a and 68a. Thus, the nozzles, the shrouds and the outer surfaces of the bucket wheels define an annular flowpath through the turbine which receives the hot gases of combustion for expansion through the various stages, thereby imparting work to the buckets and rotor.

The turbine $T_b$ illustrated in FIG. 3b has like parts similarly arranged and designated by like reference numerals, followed by the letter "b." As discussed, the turbine $T_a$ illustrated in FIG. 3a is designed for a specified power output at a certain rotational speed and power grid frequency, e.g., 3600 rpm for 60 Hz applications, while the turbine of FIG. 3b is designed for a specified power output at a different rotational speed and power grid frequency, e.g., 3000 rpm for 50 Hz applications. In accordance with the present invention, the turbines have a high degree of hardware commonality whereby the common hardware parts can be interchangeably used in either of the two turbines having the different power outputs at the different frequencies. As indicated previously, the cross-sectional area of the annulus defining the flowpath through the first, second and third stages is identical through the two turbines. However, to obtain different power outputs for a common flowpath, it is necessary to adjust the mass flow through the turbine at the different speeds of the two turbines. The flowpath inner radius is set to be common in the two turbines. The last-stage annulus can likewise be set for a given firing temperature, turbine pressure ratio and quantity of cooling air introduced, thus determining the bucket tip radius of the last stage. However, because of the high centrifugal stresses on the last stage, and the need to select an appropriate alloy for the last-stage bucket, the bucket length is limited by the higher frequency machine, e.g., a 60 Hz turbine. Consequently, to provide the increased mass flow necessary for a 50 Hz turbine, while maintaining an acceptable exit mach number and with a constant flow cross-section at least through the first, second and third stages, the height of the exit annulus of the final stage is increased to afford an increased exit area. The inner radius of the last-stage diaphragm and buckets, however, remains the same and consequently, the radius of the last-stage partitions and buckets are enlarged at the outer radius of the flowpath to meet the increased mass flow and slower speed requirements of the 50 Hz turbine as compared with the 60 Hz turbine. Further, to maintain turbine pressure ratio while accommodating increased mass flow, the first-stage nozzles and buckets are restaggered to increase their throat areas while maintaining the annulus area constant as between the two turbines. Thus, the orientation of the buckets and partitions in the first stage of the 60 Hz turbine is changed when a 50 Hz turbine is undergoing fabrication. The profiles of the airfoils of the first stage are also changed to accommodate this increase in mass flow. It has been found, however, that the speed and mass flow changes as between the 60 and 50 Hz turbines can be accommodated by a particular (and common) airfoil design in the second and third stages without substantial performance loss. Consequently, the second and third stages, including the partitions, buckets, wheels and shrouds, are sized and dimensioned identically to permit interchangeability of the second and third stages in either one of the two turbines of different power outputs and frequency applications. That is, the intermediate stages of the turbine design can be modularized for installation in either one of the two machines of different power outputs at the different frequencies. Thus, as illustrated by the common stippling in FIGS. 3*a* and 3*b*, the partitions and buckets of the second and third stages of the two machines are identical. Further, the rotor wheels for all buckets, e.g., the first, second, third and fourth-stage buckets, the spacers between the stages, the impeller plate, the aft and forward shafts, and seal plates constitute common hardware as between the 60 Hz and 50 Hz machines. Note also that the shrouds for the first, second and third-stage buckets, as well as the inner and outer shells are common between the 60 and 50 Hz turbines. Importantly, the rotors Ra and Rb are also common.

As illustrated by the different shading of the first and last stages upon comparing FIGS. 3*a* and 3*b*, the uniqueness of the 50 and 60 Hz turbines is manifested primarily in the first and last stages. Particularly in the first stage, the throat area between the partitions for the 50 Hz turbine is opened to accommodate the greater mass flow as compared with the 60 Hz turbine. With respect to the last or fourth stage, the buckets and partitions are increased in radius at their tip ends to accommodate the increased mass flow for the 50 Hz machine.

Figure 4:
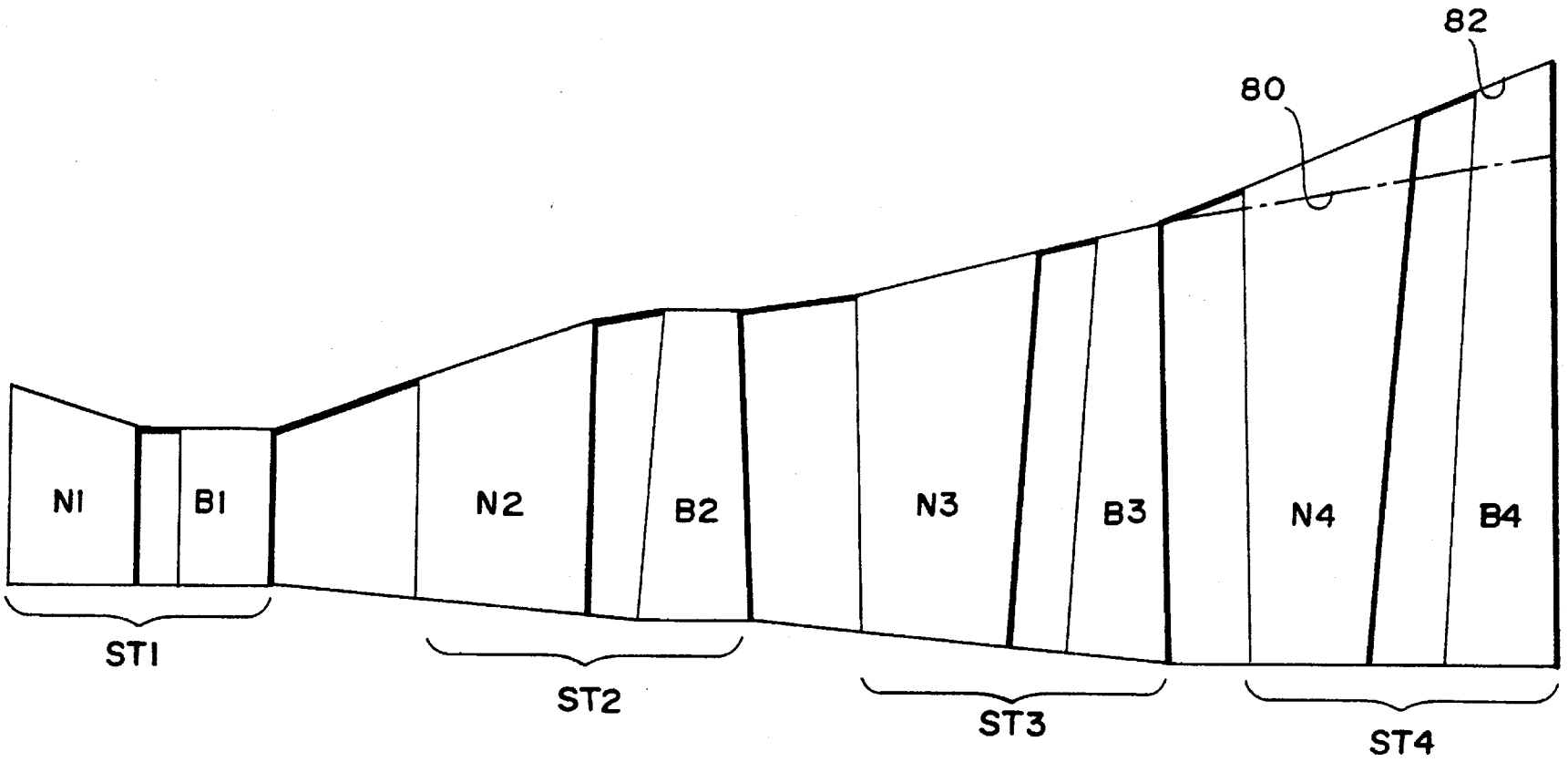
FIG. 4 is a schematic representation of the flowpath of the two turbines illustrated in FIGS. 3a and 3b.

Referring to FIG. 4, the difference in the flowpath through the two turbines of different outputs for 60 Hz and 50 Hz applications is illustrated. The first, second, third and fourth stages ST1, ST2, ST3 and ST4 are illustrated with each having nozzles and buckets designated by the letter N and B, respectively, followed by a number indicating the turbine stage. It will be appreciated that the cross-sectional area of the annulus for both the 50 Hz and 60 Hz turbines is identical for the first, second and third stages and that the flowpath through the second and third stages is identical. With respect to the fourth stage, the lower mass flow, higher speed 60 Hz machine, has an outer annulus wall 80, illustrated by the dashed line, while the larger mass flow, lower speed 50 Hz machine has an outer wall 82. The increase in the radius of the nozzles N4 and buckets B4 of the fourth stage at their tips is thus indicated by the solid line 82 for the larger mass flow lower speed 50 Hz machine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Respective identical modular components for corresponding turbine stages in first and second turbines having different power outputs and rotational speeds for power grids of different respective first and second frequencies wherein the respective rotational speeds are proportional to the respective power grid frequencies and wherein the power outputs of the turbines are not proportional to the square of the inverse of their respective power grid frequencies, said modular components comprising stationary partitions and rotatable buckets.

2. A component according to claim 1 wherein the first and second frequencies are 50 Hz and 60 Hz, respectively.

3. A turbine having a first power output and rotational speed for use in an electrical power system having a first power grid frequency and including first, intermediate and final stages, each stage comprising a fixed diaphragm having stationary partitions and a rotatable turbine wheel having buckets, at least one intermediate stage of said turbine having an identical geometry to a corresponding intermediate stage of a second turbine having a second power output and rotational speed for a second power grid frequency different from said first power output and grid frequency wherein the respective rotational speeds are proportional to the respective power grid frequencies.

4. A turbine according to claim 3 wherein said turbine having said first power output is rotatable at a first speed of 3600 RPM for a 60 Hz power grid and the second turbine having said second power output is rotatable at a speed of 3000 RPM for a 50 Hz power grid.

5. A turbine according to claim 4 wherein said first stage of said turbine having said first power output has its first stage partitions staggered closed as compared with the geometry of a first stage of the second turbine having said second power output.

6. A turbine according to claim 4 wherein said last stage of said turbine having said first power output has a lesser tip diameter as compared with the geometry of a last stage of the second turbine having said second power output.

7. A turbine according to claim 4 wherein said first stage of said turbine having said first power output has its first stage partitions staggered closed as compared with the geometry of a first stage of the second turbine having said second power output, and said last stage of said turbine having said first power output having a lesser tip diameter as compared with the geometry of a last stage of the second turbine having said second power output so as to accommodate a lower gas flow rate through said first gas turbine as compared to said second gas turbine.

8. A turbine according to claim 3 wherein said intermediate stage of said turbine having said first power output includes second and third stages having a different geometry relative to one another and the same geometry as compared with the geometry of respective second and third stages of the second turbine having said second power output.

9. A turbine according to claim 4 wherein the turbine having the first power output has a rotor identical to a rotor for the second turbine having the second power output.

10. A turbine according to claim 4 wherein said final stage of said turbine having said first power output has a cross-sectional area forming an exit annulus less than a cross-sectional area forming an exit annulus of a final stage of the second turbine having the second power output.

11. Power generating apparatus comprising:

a first turbine having a first power output for connection with a power grid of a first frequency, said first turbine having a plurality of stages, with each stage including partitions and buckets, and wherein at least one stage of said first turbine is identical to one stage of a second turbine with a similar number of stages of partitions and buckets and having a second power output different from said first power output for connection with a power grid of a second frequency.

12. Power generating apparatus according to claim 11 wherein each of said first and second turbines has first, second, third and fourth stages, said second and third stages of said first turbine and said second and third stages of said second turbine being identical.

13. Power generating apparatus according to claim 11 wherein each of said first and second turbines has a final stage of said plurality of stages and including partitions and buckets, said final stages having different cross-sectional flow areas as compared to one another.

14. Power generating apparatus according to claim 11 wherein said first and second turbines having rated speeds for 60 Hz and 50 Hz applications, respectively, each said first and second turbines having first, intermediate and final stages, said final stage for said first turbine having an exit annulus of a cross-sectional area less than the cross-sectional area of the exit annulus of the final stage for said second turbine.

15. Power generating apparatus according to claim 11 wherein each said first and second turbines has first, intermediate and final stages, the flowpath geometry through said intermediate stages of said first turbine being identical to the flowpath geometry through said intermediate stage of said second turbine.

16. Power generating apparatus comprising:

a first turbine operable at a first rated speed;

a second turbine operable at a second rated speed different from said first speed;

each said first and second turbines having a plurality of stages, with each stage including partitions and buckets;

at least one stage in said first turbine and one stage of said second turbine having identically sized and configured partitions and buckets;

said first and second turbines having sizes not geometrically scaled according to speed.

17. Power generating apparatus according to claim 16 wherein said first and second turbines have identically sized rotors upon which said buckets are mounted.

18. A method of manufacturing turbines for use at different power outputs comprising the steps of:

selecting a desired power output for a first turbine having first, intermediate and final stages, each stage having partitions and buckets;

establishing the geometry for the partitions and buckets of each stage for said first turbine;

selecting a desired power output for a second turbine having first, intermediate and final stages, each stage of said second turbine having partitions and buckets; and said selected power outputs being unrelated to geometric scaling of said first and second turbines;

establishing the geometry for the partitions and buckets of each stage for said second turbine including providing an intermediate stage of said second turbine with a geometry identical to the geometry of the intermediate stage of said first turbine.

19. A method of manufacturing first and second turbines having substantially identical firing temperatures and pressure ratios for use with gas flows having substantially identical properties wherein each turbine has first, intermediate and final stages with each stage including partitions and buckets, comprising the steps of:

forming a pair of first stages for installation in said first and second turbines, respectively, wherein said first stages have geometries different from one another;

forming a pair of last stages for installation in said first and second turbines, respectively, wherein said last stages have geometries different from one another;

forming a pair of intermediate stages having geometric characteristics identical to one another for installation in said first and second turbines, respectively; and installing the stages in said first and second turbines, respectively.

20. In a gas turbine for use in electrical power generation applications having first, intermediate and last turbine stages and rated at a first power output at a first rotational speed which is proportional to the frequency of a power grid with which it is intended to be operated, the improvement comprising said intermediate turbine stage which is interchangeable with the same stage of another gas turbine of like number of turbine stages rated at a second power output at a second rotational speed similarly proportional to the frequency of a power grid with which it is intended to be operated.

21. The gas turbine of claim 20 wherein said first rotational speed and power grid frequency are 3600 rpm and 60 Hz, respectively, and said second rotational speed and power grid frequency are 3000 rpm and 50 Hz, respectively.

22. In a method of designing a family of gas turbines for use in electrical power generation applications including a first gas turbine rated for a first power output when operated at a first rotational speed which is proportional to the 60 Hz frequency of an electrical power grid with which it is intended to be operated, and a second gas turbine rated for a second power output when operated at a second rotational speed which is similarly proportional to the 50 Hz frequency of an electrical power grid with which it is intended to be operated, each of said gas turbines having an equal number of turbine stages of three or more comprising alternating rows of stationary partitions and rotatable buckets affixed to a common rotor, the step of providing at least one intermediate stage of partitions and buckets which are interchangeable between said two gas turbines.

* * * * *